US005201674A

United States Patent [19]

Okura

[11] Patent Number: 5,201,674

[45] Date of Patent: Apr. 13, 1993

[54] WIRING CONNECTOR

[75] Inventor: Yoshio Okura, Yokkaichi, Japan

[73] Assignee: Sumitomo Wiring Systems, Ltd., Mie, Japan

[21] Appl. No.: 896,449

[22] Filed: Jun. 10, 1992

[30] Foreign Application Priority Data

Jun. 13, 1991 [JP] Japan ..... 3-44445[U]

[51] Int. Cl.[5] ..... H01R 13/424

[52] U.S. Cl. ..... 439/595; 439/594; 439/599; 439/717; 439/752

[58] Field of Search ..... 439/594, 595, 599, 603, 439/711, 717, 718, 751, 752, 892

[56] References Cited

U.S. PATENT DOCUMENTS

| | | | |
|---|---|---|---|
| 4,005,925 | 2/1977 | Sudre | 439/594 |
| 4,243,288 | 1/1981 | Lucius et al. | 439/599 |
| 4,368,939 | 1/1983 | Foederer | 439/594 |
| 5,122,077 | 6/1992 | Maejima et al. | 439/717 |

FOREIGN PATENT DOCUMENTS 62-200252 12/1987 Japan .

*Primary Examiner*—Paula A. Bradley
*Attorney, Agent, or Firm*—Sughrue, Mion, Zinn, Macpeak & Seas

[57] ABSTRACT

A connector comprising an upper housing and a lower housing connected with each other vertically and each having terminal accommodating chambers arranged in parallel with each other therein and a cover interposed therebetween with projections extending upwardly and downwardly therefrom. An electric wire is fixedly sandwiched in the longitudinal direction of the electric wire between the upper and lower edges of the projections and the rear end of the upper and lower end surfaces of the terminal accommodating chambers. The terminal is locked at the rear end thereof by the front end of the projections and also locked at a front portion thereof by a terminal-locking portion formed on the wall of each terminal accommodating chamber.

2 Claims, 5 Drawing Sheets

WIRING CONNECTOR

BACKGROUND OF THE INVENTION

1. Field of the Invention

The present invention relates to a connector and more particularly to a connector comprising a cover having a function of fixing an electric wire in a connector housing and locking a terminal thereto. The connector of the present invention is preferably used as a connector having a terminal accommodating chamber for accommodating terminals of a plurality of wires used in an electronic appliance or a wire harness of an automobile.

2. Description of the Related Arts

According to a conventional connector accommodating terminals connected with a plurality of wires of a wire harness of an automobile or the like, the terminals are inserted into a plurality of terminal accommodating chambers arranged in parallel with each other in the housing of the connector and the terminals are locked by a terminal locking portion formed in each terminal accommodating chamber. Then, a cover is installed on the housing so as to close the opening portion of each terminal accommodating chamber. The cover has a function of insulating the electric wire but does not have a function of fixing the electric wire to the terminal accommodating chamber.

Therefore, the conventional connector does not firmly hold the electric wire. If tensile force acts on the electric wire, the terminal connected with the electric wire is moved in the terminal accommodating chamber, thus causing an imperfect contact or the terminal to be removed from the terminal accommodating chamber together with the electric wire. In addition, the terminal is likely to be damaged due to repeated installations and removals of male and female connectors.

In order to solve the above-described disadvantage, the following construction has been proposed: A projection 2*a* having a construction as shown in FIG. 5 is formed to close the opening portion positioned in the rear upper end of the housing 1 of the connector. An electric wire 5 connected with a terminal 3 accommodated in a terminal accommodating chamber 1*a* is bent along the projection 2*a* to fix the electric wire 5 in the terminal accommodating chamber 1*a*.

However, when force acts on the electric wire 5 as shown by an arrow of FIG. 5, force for removing the cover 2 from the housing 1 acts on a curved portion 5*a* of the electric wire 5 as shown by an arrow of FIG. 5. As a result, the cover 2 is deformed or removed from the housing 1. As such, the cover 2 is incapable of fixing the electric wire in the terminal accommodating chamber 1*a*.

Another example of a conventional connector is described below with reference to FIG. 6. According to this example, a blade 3*a*' of a terminal 3, accommodated in a terminal accommodating chamber 1*a*' of a housing 1' is perpendicular to a connector-connected surface and the electric wire 5 connected with the terminal 3' is bent by side walls 2*b*' of a cover 2' so as to fix the electric wire 5 to the terminal accommodating chamber 1*a*'.

However, force for removing the cover 2' from the housing 1' is generated upon application of force acting the electric wire 5. As a result, the cover 2' is deformed or removed from the housing 1' and thus the electric wire 5 cannot be reliably fixed to the terminal accommodating chamber 1*a*'.

In addition, according the conventional connectors as shown in FIGS. 5 and 6, the terminal accommodated in the terminal accommodating chamber is held by only a locking portion 1*b* and 1*b*', respectively formed on the wall of the terminal accommodating chamber. Thus, the terminal cannot be reliably locked sufficiently in the terminal accommodating chamber.

The above-described connector has only a single layer of terminal accommodating chambers. The following connector comprising a two-layered terminal accommodating chambers disclosed in Japanese Utility Model Laid-Open Publication No. 62-200252 is described below with reference to FIGS. 7 and 8.

Housings 6A and 6B comprising a single layered terminal accommodating chamber 1*a*" are connected with each other by a band 7 and layered one on the other to form a two-layered terminal accommodating chamber. A connecting member 8 corresponding to a cover is interposed between the housings 6A and 6B. Wire-fixing projections 8*a* and 8*b* formed upward and downward therefrom are formed on the rear end of the connecting member 8.

According to the above connector, the electric wire 5 is vertically sandwiched in the same direction between the projections 8*a*(8*b*) of the connecting member 8 projecting at right angles with the bottom surface (upper surface) of the terminal accommodating chamber 1*a*" as shown in FIG. 8. Therefore, the connecting member 8 is incapable of favorably suppressing tensile force acting the electric wire 5 in the direction shown by an arrow shown by X and thus, is incapable of reliably fixing the electric wire 5 to the terminal accommodating chamber 1*a*".

Further, a terminal 3" accommodated in the terminal accommodating chamber 1*a*" is locked by only a stepped portion 1*c*" formed on the bottom wall of the terminal accommodating chamber 1*a*". Therefore, the terminal 3" is not firmly held. When tensile force acts on the electric wire 5, the terminal 3" is likely to move due to the weak fixing force of the projection 8*b*. As a result, the connecting member 8 may be deformed.

As described above, according to the conventional connector having the single-layered and the two-layered terminal accommodating chamber, the cover is incapable of fixing the electric wire reliably to the terminal accommodating chamber and as such the cover is likely to be deformed or removed therefrom.

SUMMARY OF THE INVENTION

It is an object of the present invention to provide a connector comprising a cover having a function of fixing an electric wire reliably to a terminal accommodating chamber and locking a terminal in the housing of the connector.

It is another object of the present invention to provide a connector having a multi-layered terminal accommodating chamber.

In accomplishing this and other objects of the present invention, there is provided a connector comprising: an upper housing and a lower housing connected with each other vertically and each having terminal accommodating chambers arranged in parallel with each other therein and a cover interposed therebetween. In this construction, the cover has projections extending upwardly and downwardly therefrom in such a manner that the position of each of the projections correspond to the position of each terminal accommodating chamber; and both upper and lower edges of the projection are disposed rearwardly of the rear end of the upper and lower end surfaces of the terminal accommodating chambers of the housing so that an electric wire is fixedly sandwiched between the projections and the rear end of the upper and lower end surfaces of the terminal accommodating chambers.

The upper housing comprises terminal accommodating chambers having a space in the lower portion thereof and arranged in parallel with each other. The lower housing comprises terminal accommodating chambers having a space in the upper portion thereof and arranged in parallel with each other. Both partitioning walls of each terminal accommodating chamber are longer than the upper wall of the upper housing and the lower wall of the lower housing. The rear end of the upper and lower walls of the terminal accommodating chamber of the upper and lower housings are positioned forward of the projection of the front end of the cover interposed between the upper and lower housings. A space is provided between the projection of the cover and the rear end of the upper wall of the upper housing as well as the lower wall of the lower housing. The sectional area of the space is adjusted so that the electric wire is sandwiched therebetween in the space under pressure.

According to another preferred embodiment, there is provided a connector comprising: a dovetail groove formed rearwardly from the front of the lower surface of the upper housing; a first projection, formed rearwardly from the front of the upper surface of the lower housing, which engages the dovetail groove; a locking groove formed on the left wall and the right wall of the upper housing at the rear end thereof, respectively; and a second projection, engaging the locking groove, formed on the upper surface of left and right outer walls of the lower housing at the rear end thereof. In the above construction, the left and right outer walls of the lower housing are higher than inner partitioning walls of the terminal accommodating chambers; and the upper housing is removably coupled with the lower housing with the cover-inserting space provided therebetween by the slidable engagement between the dovetail groove and the first projection and the slidable engagement between the locking groove and the second projection.

The upper and lower housings have a terminal-locking portion, respectively at the front end of the opening portion provided in the upper portion of the upper housing and at the front end of the opening portion provided in the lower portion of the lower housing. In addition, the rear end of the terminal-locking portions are rounded.

The front end of the flat plate which is brought in contact with the rear end of the terminal-locking portions is also rounded. Therefore, the upper and lower housings and the cover can be easily coupled with each other without damaging the contact portion thereof.

The cover comprises a thick flat plate which is fitted in the space between the upper and lower housings. The flat plate closes the lower opening portion formed in the terminal accommodating chamber of the upper housing as well as the upper opening portion formed in the terminal accommodating chamber of the lower housing. An electric wire guide holding portion is formed on the upper and lower ends of each projection disposed at the rear end of the upper and lower surface of the flat plate. A locking groove for placing the cover in position is formed at the rear end of the flat plate. The locking groove engages a projection formed at the rear end of the center partitioning wall of the lower housing so that the front end of the flat plate is sandwiched between the lower wall of the upper housing and the upper wall of the lower housing. Thus, the cover is placed in position between both housings.

Although the above-described connector comprises the upper and lower housings each having one-layered terminal accommodating chambers, it is possible to manufacture a connector having a multi-layered terminal accommodating chambers by connecting a plurality of the connectors having upper and lower housings.

A plurality of connectors may be removably connected with each other by dovetail grooves and projections engaging the dovetail grooves or by a band.

According to the connector of the above-described construction, in accommodating the electric wire in each terminal accommodating chamber, the electric wire connected with a terminal is sandwiched between the rear end of the upper surface of the upper housing and the upper end of the projection of the cover, while the electric wire accommodated in each terminal accommodating chamber of the upper housing is longitudinally sandwiched between the rear end of the lower surface of the lower housing and the lower end of the projection of the cover. This construction suppresses tensile force longitudinally applied to the electric wire. In addition, when tensile force acts on the cover in the direction in which the lower electric wire is loosened, the upper wire is subjected to force in the direction in which the force for sandwiching the upper electric wire increases. That is, if tensile force acts on the lower electric wire and as a result, if an upward force is applied to the cover, the force for sandwiching the upper electric wire increases. As a result, reaction is applied to the cover in the downward direction, thus preventing the deformation of the cover and stabilizing the force for sandwiching the upper and lower electric wires.

The terminal inserted into each terminal accommodating chamber is locked by the terminal locking portion of the terminal accommodating chamber and the front end of the projection of the cover. Therefore, the terminal can be reliably locked in the terminal accommodating chamber at the predetermined position thereof. Thus, the shaking, imperfect contact or removal of the terminal accommodated in the terminal accommodating chamber can be prevented.

Since the contact portion of the housing and that of the cover are rounded, they can be smoothly coupled with each other without damaging the contact portion thereof. In addition, since one cover is used for two connectors each having two-layered terminal accommodating chambers, the connector can be manufactured at a low cost and can be assembled easily.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE INVENTION

Figure 1:
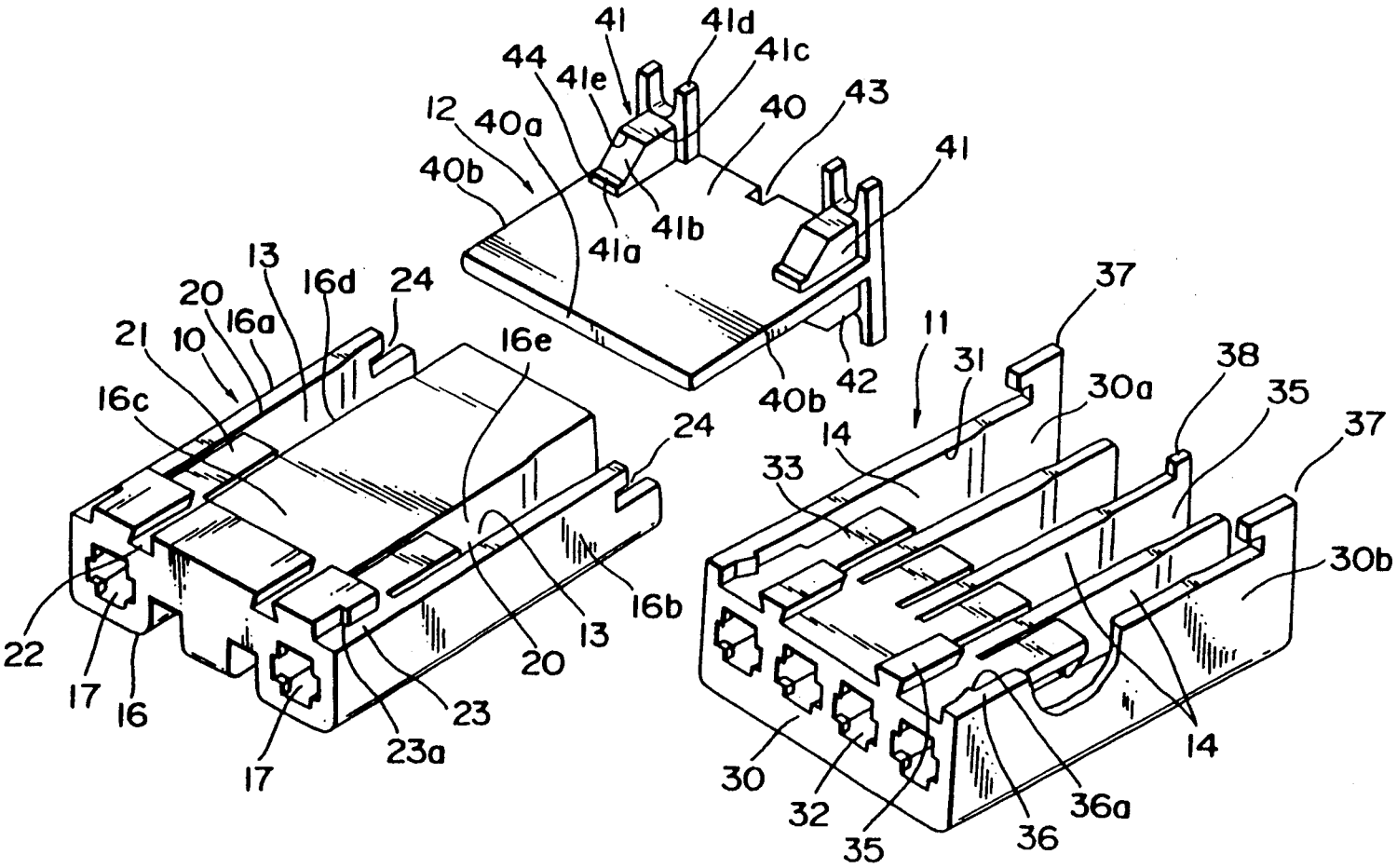
FIG. 1 is an exploded perspective view showing components of a connector according to an embodiment of the present invention.

Before the description of the present invention proceeds, it is to be noted that like parts are designated by like reference numerals throughout the accompanying drawings.

Figure 2:
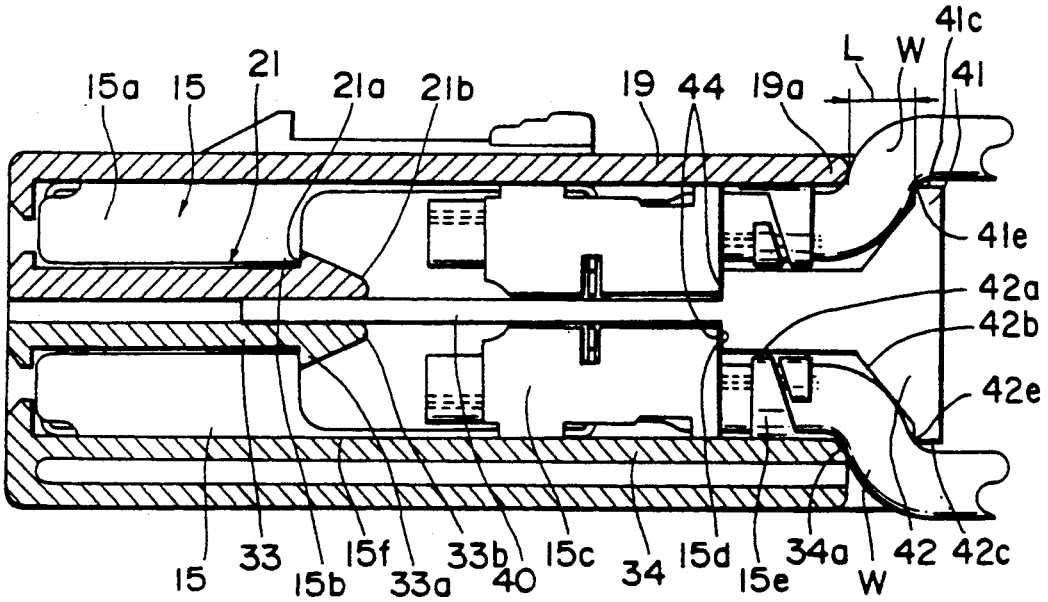
FIG. 2 is a sectional view showing a connector assembled from the components shown in FIG. 1.

A connector according to an embodiment of the present invention will be described below with reference to FIGS. 1 through 4. Referring to FIG. 1 in which an upper connector 10 is turned upside down, the connector comprises an upper connector 10; a lower connector 11; and a cover 12. The upper connector 10 and the lower connector 11 have a plurality of terminal accommodating chambers 13 and 14, respectively. As shown in FIG. 2, a terminal 15 having an electric wire W connected therewith is inserted into the terminal accommodating chambers 13 and 14. Then, the cover 12 is installed on the upper surface of the lower connector 11 and thereafter, the upper connector 10 is turned upside down to install it on the upper surface of the cover 12. Thus, the connector has two-layered terminal accommodating chambers and is assembled from the upper connector 10, the lower connector 11, and the cover 12.

Figure 3:
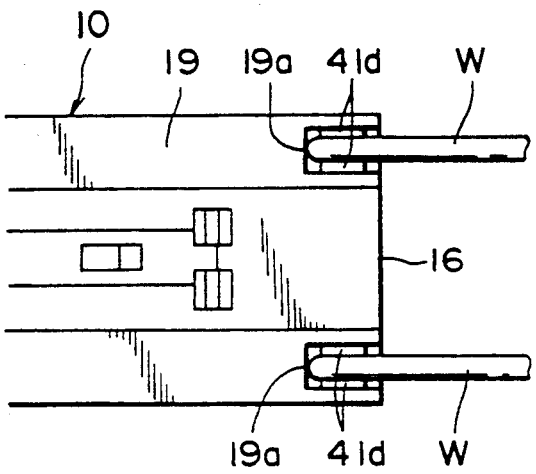
FIG. 3 is a partial plan view of FIG. 2.
Figure 4:
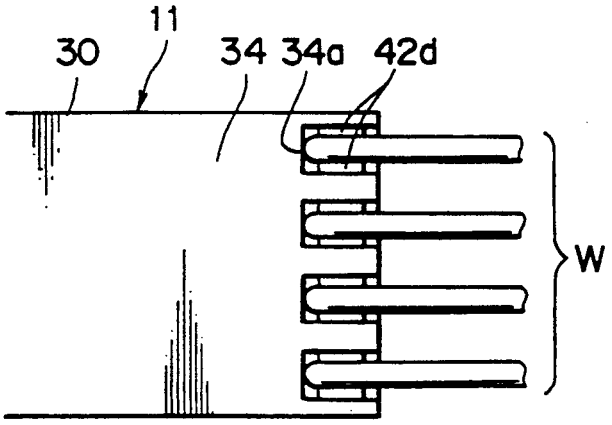
FIG. 4 is a partial bottom view of FIG. 2.

The upper connector 10 has two terminal accommodating chambers 13 formed in the left and right sides of the housing 16 thereof. An opening portion 20 is formed from the rear end of each terminal accommodating chamber 13 to the vicinity of the front portion thereof. The front portion of the opening portion 20 is denoted as a cavity 17 into which an electric-contact portion 15*a* of the terminal 15 is inserted. The left and right outer walls 16*a* and 16*b* of the housing 16 serve as one of the side walls of each terminal accommodating chamber 13. The partitioning walls 16*d* and 16*e* of a center partitioning wall 16*c* of the housing 16 serve as the other side wall of the terminal accommodating chamber 13. As shown in FIG. 3, the rear end 19*a* of the upper surface (lower surface in FIG. 1) 19 of each terminal accommodating chamber 13 is positioned forward of the rear end of each of the outer walls 16*a* and 16*b* and the partitioning walls 16*d* and 16*e* with a predetermined interval spaced therefrom.

In the opening portion 20 of the terminal accommodating chamber 13, a terminal-locking portion 21 projects from the lower surface of the cavity 17. As shown in FIG. 2, the terminal-locking portion 21 has a locking claw 21*a* projecting upwardly in the rear end of a flat portion thereof. The locking claw 21*a* locks the rear end 15*b* of the electric-contact portion 15*a* of the terminal 15. The rear end 21*b* of the terminal-locking portion 21 is rounded.

There is provided locking means for coupling the upper connector 10 with the lower connector 11 in the front and rear of the lower surface of the housing 16.

More specifically, as shown in FIG. 1, a dovetail groove 22 is formed rearward from the front of the lower surface of the housing 16 on the left and right sides thereof, and a cut-out 23 having a stepped stopping surface 23*a* is formed in the front left end of the housing 16 and the front right end thereof. In addition, a locking groove 24 is formed at the rear end of each of the left and right outer walls 16*a* and 16*b* of the housing 16.

As shown in FIG. 1, the lower connector 11 has four terminal accommodating chambers 14 arranged in parallel with each other and each having an opening portion 31 formed therein. Similarly to the terminal accommodating chamber 13 of the upper connector 10, the terminal accommodating chamber 14 has a cavity 32 in the front thereof and a terminal locking portion 33 projecting from the upper surface of the cavity 32. A locking claw 33*a* is formed on the terminal locking portion 33 and the rear end 33*b* thereof is rounded. The rear end 34*a* of the lower surface 34 of the terminal accommodating chamber 14 is positioned forward of the rear end of partitioning walls 35 and the outer walls 30*a* and 30*b* of the terminal accommodating chambers disposed on the left and right sides of the housing 30.

The lower connector 11 has in the upper front thereof a projection 35 formed rearward from the front of the upper surface of the housing 30 on the left and right sides thereof. The projection 35 engages the dovetail groove 22 of the upper connector 10. A projection 36 which engages the cut-out 23 of the upper connector 10 is formed on the front left end of the housing 30 and the front right end thereof. That is, the inner projected surface 36*a* of the projection 36 engages the stopping surface 23*a* of the upper connector 10. In addition, a projection 37 is formed on the upper surface of the housing 30 at the rear end of the outer walls 30*a* and 30*b* thereof. The projection 37 engages the locking groove 24 formed at the rear end of the housing 16 of the upper connector 10.

A projection 38 for placing the cover 12 in position and holding it is formed at the rear end of the upper surface of the center partitioning wall 35 of the housing 30.

Two projections 41 are formed upwardly from the rear end of a flat plate 40 of the cover 12 and four projections 42 are formed downwardly from the rear end at the flat plate 40. The projections 41 and 42 are positioned at the rear end of the terminal accommodating chambers 13 and 14 in coupling the upper connector 10, the lower connector 11, and the cover 12 with each other.

In coupling the upper connector 10, the lower connector 11, and the cover 12 with each other, the vertical front edge 40*a* of the flat plate 40 is in contact with the rear end of the lower surface of the upper connector 10 extending rearward from the front thereof, and vertical left and right edge surfaces 40*b* of the cover 12 are in contact with the inner of the outer walls 30*a* and 30*b* of the lower connector 11. A locking groove 43 is formed at the center of the rear of the flat plate 40. The locking groove 43 engages the projection 38 of the lower connector 11, thus holding the cover 12 in position.

The projections 41 and 42 are similar to each other in the configuration thereof and as such only the projection 41 formed upwardly from the rear of the flat plate 40 is described below.

The projection 41 comprises a front stepped portion 41*a* projecting upwardly from the flat plate 40 at a right angle therewith; an inclined portion 41*b* continuous rearwardly from the front stepped portion 41*a*; a rear stepped portion 41c extending horizontally rearwardly from the rear end of the inclined portion 41b; and a wire guide portion 41d continuous from the rear end of the rear stepped portion 41c.

As shown in FIG. 2, the front end surface 44 of the front stepped portion 41a of the projection 41 locks the rear end 15d of a wire crimping portion 15c or the terminal 15 in assembling the connector. Thus, the front end surface 44 of the front stepped portion 41a is denoted as a terminal-locking surface 44. As shown in FIG. 2, the front edge 41e of the rear stepped portion 41c is positioned rearwardly from the upper rear end 19a of the terminal accommodating chamber 13 by a predetermined interval L so that the electric wire W can be held between the upper rear end 19a and the projection 41 and positioned below the upper surface 19 by a small interval. Similarly to the projection 41, the interval L the front edge 42e of the rear stepped portion 42c of the projection 42 is positioned rearward from the upper rear end 34a of the terminal accommodating chamber 14 by a predetermined interval L.

The terminal 15 connected with the electric wire W accommodated in the terminal accommodating chambers 13 and 14 comprises the electric-contact portion 15a disposed in the front section thereof; a wire crimping portion 15c, containing a pressing blade, (not shown) disposed in the intermediate section thereof; and an electric wire holding portion 15e in the rear section thereof. The three portions 15a, 15c, and 15e integral with each other projecting from a base plate 15f. The electric wire W is connected with the terminal 15 before the terminal 15 is mounted in the connector.

The method for coupling the upper connector 10, the lower connector 11, and the cover 12 with each other will be described below.

In inserting the terminal 15 connected with the electric wire W into the terminal accommodating chamber 13 of the upper connector 10 and the terminal accommodating chamber 14 of the lower connector 11 from each rear opening, the terminal locking portions 21 and 33 are pressed upward by the electric-contact portion 15a of the terminal 15. When the terminal 15 is positioned at a predetermined distance therein, the rear end 15b of the electric-contact portion 15a is locked by the claw 21a of the terminal-locking portion 21 and the claw 33a of the terminal locking portion 33.

Then, the projection 38 of the lower connector 11 is engaged by the locking groove 43 disposed at the rear end of the cover 12. Thus, the cover 12 is mounted on the lower connector 11. At this time, the left and right end surface 40b of the flat plate 40 of the cover 12 are held by the inner surface of the outer walls 30a and 30b of the housing 30, and the front surface 40a of the flat plate 40 contacts the rear end surface of the projection 35. The cover 12 can be installed on the lower connector 11 without damaging the contact portions between the cover 12 and the lower connector 11 because the front end surface 40a of the flat plate 40 is rounded.

As a result of the installation of the cover 12 on the lower connector 11, the opening portion 31 of the terminal accommodating chamber 14 of the lower connector 11 is closed by the flat plate 40 of the cover 12 and the front end of the front stepped portion 42a of the projection 42 locks the rear end 15d of the wire crimping portion 15c. Thus, the terminal 15 is locked by the terminal locking portion 33 and the front stepped portion 42a in the terminal accommodating chamber 14.

The electric wire W connected with the terminal 15 is bent along the inclined portion 42b of the projection 42 and fixed by being sandwiched between the rear end 34a of the terminal accommodating chamber 14 and the front edge 42e of the rear stepped portion 42c as shown in FIG. 2.

After the cover 12 is installed on the lower connector 11, the upper connector 10 shown in FIG. 1 is turned upside down to couple the upper connector 10 with the lower connector 11 by sliding the upper connector 10 rearwardly on the lower connector 11 with the dovetail groove 22 engaging the projection 35. Then, the locking groove 24 of the upper connector 10 engages the projection 37 of the lower connector 11, and the stopping surface 23a of the cut-out groove 23 engages the stepped surface 36a of the projection 36. In this manner, the upper connector 10 is firmly coupled with the lower connector 11 with the cover 12 interposed therebetween.

As a result, the opening portion 20 of the terminal accommodating chamber 13 of the upper connector 10 is covered with the flat plate 40 of the cover 12, and the rear end 15d of the wire crimping portion 15c of the terminal 15 accommodated in the terminal accommodating chamber 13 is locked by the terminal locking surface 44 of the projection 41 of the cover 12. That is, the terminal 15 is locked by the terminal locking surface 44 and the terminal-locking portion 21. The electric wire W is bent upwardly along the inclined portion 41b and sandwiched between the upper rear end 19a of the terminal accommodating chamber 13 and the front edge 41e of the rear stepped portion 41c.

In this manner, the connector having the upper and lower terminal accommodating chambers 13 and 14 is assembled as shown in FIG. 2.

The cover 12 interposed between the upper connector 10 and the lower connector 11 locks the terminal 15 accommodated in the terminal accommodating chambers 13 and 14 at two points. The upper electric wire W and the lower electric wire W bent upwardly and downwardly, respectively are fixed in the connector.

Figure 5:
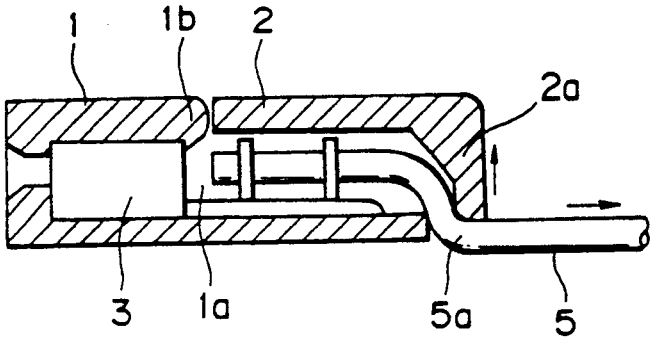
Fig. 5 PRIOR ART
FIG. 5 is a schematic sectional view showing a conventional connector.
Figure 6:
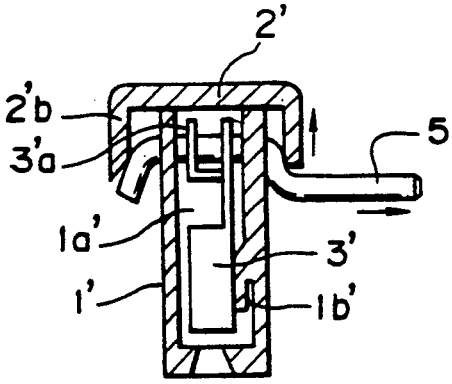
Fig. 6 PRIOR ART
FIG. 6 is a schematic sectional view showing another conventional connector.
Figure 7:
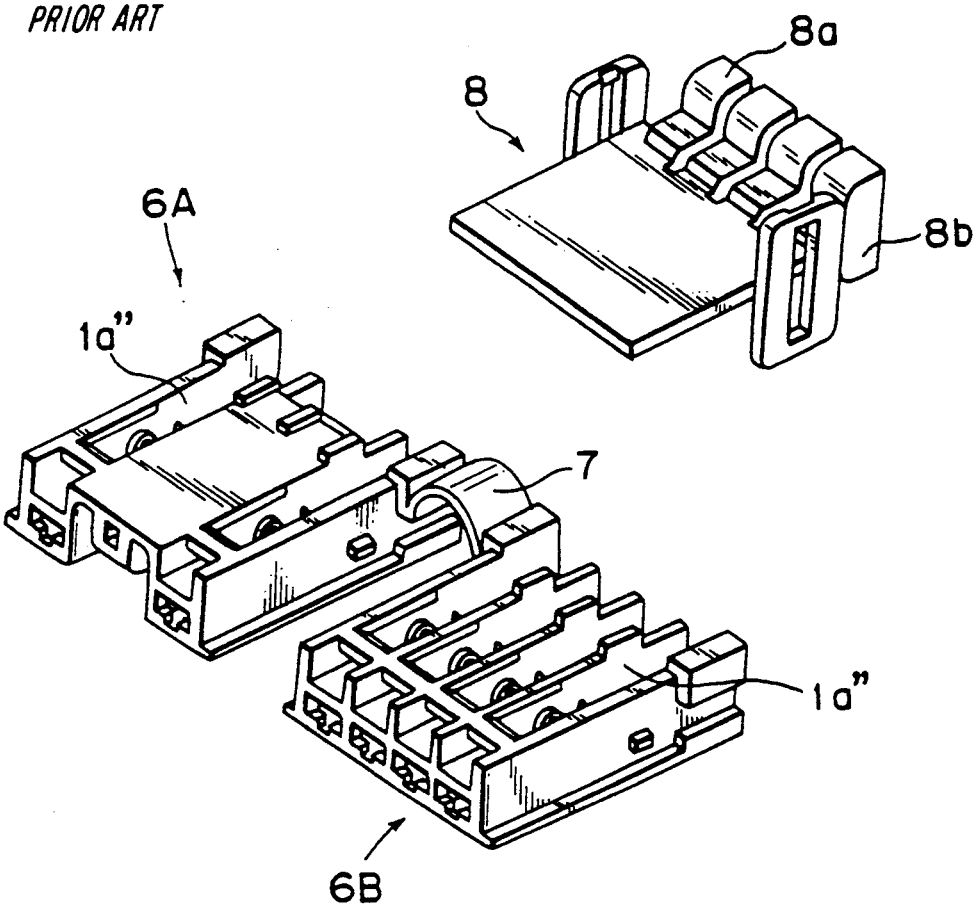
Fig. 7 PRIOR ART
FIG. 7 is an exploded perspective view showing still another conventional connector.
Figure 8:
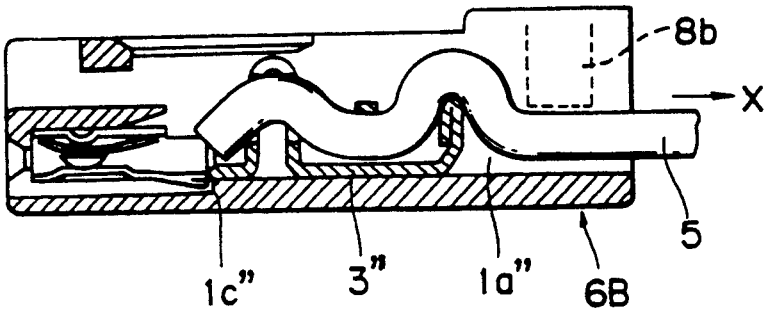
Fig. 8 PRIOR ART
FIG. 8 is a sectional view showing the conventional connector of FIG. 7.

If tensile force acts on the lower electric wire W fixed in the upper and lower terminal accommodating chambers as shown in FIG. 2 in the direction as shown by the arrow of FIG. 5 and the force acts upwardly on the cover 12, force is increasingly applied to the upper electric wire W. Consequently, a downward force is applied to the cover 12 as a result of generated reaction. As a result, force applied to the upper and lower wires W becomes stable. A similar phenomenon occurs when tensile force acts on the upper electric wire W.

The connector of the present invention provides the following advantages:

The upper and lower electric wires connected with the terminal accommodated in the terminal accommodating chambers of the upper and lower housings can be by using one cover interposed between the upper and lower housings. In addition, if tensile force acts the upper electric wire or the lower electric wire and as such force is applied to the cover in the wire-loosening direction, force for sandwiching the other electric wire increases. As a result, force is applied to the cover in the wire-stretching direction. Therefore, the cover can be prevented from being deformed or removed from the terminal accommodating chamber and thus force for retaining the electric wire becomes stable. As such, the electric wire can be reliably fixed to the terminal accommodating chamber. Since the electric wire is retained in the longitudinal direction in which tensile force is applied, the electric wire can be firmly retained in the terminal accommodating chamber compared with the case in which the electric wire is held vertically.

One cover closes the opening portion of the two-layered terminal accommodating chamber. The terminal is locked in cooperation of the projection thereof and the locking portion formed on the wall of the terminal accommodating chamber in the front and rear of the terminal. Therefore, the terminal can be prevented from being moved or removed from the terminal accommodating chamber by tensile force applied to the electric wire.

The upper and lower housings are locked by the dovetail groove and the projection in the front thereof and by the locking groove and the projection with the cover interposed between the upper and lower housings. Thus, the upper and lower housings can be firmly connected with each other. Therefore, the electric wire can be reliably and easily bent and held reliably in the terminal accommodating chamber.

The upper and lower housings can be easily connected with each other by sliding the upper housing along the projection of the lower connector. In addition, the contact portions between the cover and the upper connector as well as the lower connector are rounded. Thus, they can be connected with each other smoothly and prevented from being damaged.

A multi-layered connector can be manufactured by connecting the connector having two-layered terminal accommodating chambers.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A connector comprising:

an upper housing and a lower housing connected with each other vertically and each having terminal accommodating chambers arranged in parallel with each other therein, said terminal accommodating chambers including upper and lower end surfaces; and a cover, interposed between said upper housing and said lower housing, having projections extending upwardly and downwardly therefrom in such a manner that a position of each of said projections corresponds respectively to a position of each terminal accommodating chamber; and both upper and lower edges of each of said projections being disposed rearwardly of a rear end of the upper and lower end surfaces of said terminal accommodating chambers of said upper and lower housings so that an electric wire is fixedly sandwiched between each of said projections and the rear end of the upper and lower end surfaces of said terminal accommodating chambers.

2. The connector as defined in claim 1, wherein said upper housing includes a lower surface, a left wall and a right wall, and said lower housing includes an upper surface, left and right outer walls, and inner partitioning walls which define said terminal accommodating chambers in said lower housing, said connector further comprising:

a dovetail groove extending rearwardly from a front of the lower surface of said upper housing;

a first projection, extending rearwardly from a front of the upper surface of said lower housing, which slidably engages said dovetail groove;

a locking groove formed on the left wall and the right wall of said upper housing at a rear end thereof, respectively; and a second projection, slidably engaging said locking groove, formed on an upper surface of said left and right outer walls of said lower housing at a rear end thereof, in which:

said left and right outer walls of said lower housing are higher than said inner partitioning walls of said terminal accommodating chambers of said lower housing; and said upper housing is removably coupled with said lower housing by the slidable engagement between said dovetail groove and said first projection and the slidable engagement between said locking groove and said second projection, such that a cover-inserting space is formed between said upper housing and said lower housing.

* * * * *